US007163517B2

(12) United States Patent
Liu et al.

(10) Patent No.: US 7,163,517 B2
(45) Date of Patent: Jan. 16, 2007

(54) ELECTRO-STIMULATION FEET ACUPUNCTURE CHANNEL PHYSIOTHERAPY SHOE

(76) Inventors: Chieh-Lin Liu, No. 18, Lane 163, Gongjheng Road, West District, Taichung City (TW); Hao-Hua Hung, No. 18, Lane 163, Gongjheng Road, West District, Taichung City (TW)

( * ) Notice: Subject to any disclaimer, the term of this patent is extended or adjusted under 35 U.S.C. 154(b) by 171 days.

(21) Appl. No.: 10/918,505

(22) Filed: Aug. 16, 2004

(65) Prior Publication Data

US 2006/0036197 A1 Feb. 16, 2006

(51) Int. Cl.
*A61H 39/00* (2006.01)

(52) U.S. Cl. ..... 601/15; 601/21; 601/22; 607/2

(58) Field of Classification Search ..... 601/15–17, 601/20, 21, 22; 607/2, 48–49, 72–76, 144; 36/28, 29, 44, 88; 600/13–15
See application file for complete search history.

(56) References Cited

U.S. PATENT DOCUMENTS 4,832,032 A * 5/1989 Schneider ..... 607/115
5,782,893 A * 7/1998 Dennis, III ..... 607/48
6,615,080 B1 * 9/2003 Unsworth et al. ..... 607/2
2004/0059336 A1 * 3/2004 Yu ..... 607/2
2005/0187601 A1 * 8/2005 Wang ..... 607/144

* cited by examiner

*Primary Examiner*—Quang D. Thanh
(74) *Attorney, Agent, or Firm*—Rabin & Berdo, P.C.

(57) ABSTRACT

An electro-stimulation feet acupuncture channel physiotherapy shoe comprised of a pair of physiotherapy shoes and an accompanying physical treatment appliance. Conductive metal wires are directly embedded along the interior extent of the shoe body, a small hole is formed in the rear surface of each shoe body, a surrounding edge is disposed along the periphery of the sole, and three-dimensional acupressure point protrusions and massage protrusions with built-in wire wound coils that provide for electrical conductance are reliefed along the instep. The physical treatment appliance enables the physiotherapy shoe to become positively and negatively conductive, causing the generation of low and medium frequency electric waves that have physical therapy and health care effectiveness at the reflex areas along the soles of the feet.

3 Claims, 3 Drawing Sheets

ELECTRO-STIMULATION FEET ACUPUNCTURE CHANNEL PHYSIOTHERAPY SHOE

BACKGROUND OF THE INVENTION

1) Field of the Invention

The invention herein relates to an electro-stimulation feet acupuncture channel physiotherapy shoe that provides electric waves suitable for human body applications in which the electric wave frequencies stimulate the reflex area, acupuncture channels along the soles of the feet to improve circulation, relieve fatigue, and reach body muscles and blood vessels to strengthen physical immunity as well as restore and increase natural body healing capability, the present invention thereby serving as a therapeutic and recuperative medical treatment instrument.

2) Description of the Prior Art

Currently observed appliances that provide for massaging the acupuncture channels along the soles of the feet include products worn as massage shoes, electric-powered foot sole massagers, and extension conductive contact electro-stimulation machines. The massage shoes consist of massage nodules directly disposed on the instep in which the weight of the user causes contact between the acupuncture points along soles of the feet and the massage nodules, thereby effectively massaging the acupuncture channels. However, since individual foot shapes are not identical, the massage effectiveness is less than optimal.

Additionally, utilizing the extension conductive contact electro-stimulation machines involves an electro-stimulation model in which low frequency electro-stimulation methods electrically stimulate shallow tissue layers of the body. However, since such approaches are only capable of the temporary relief of mild symptoms, electro-stimulation efficiency is not the best.

As a result, the said methods are incapable of effectively reaching deep tissue layer, muscle and blood vessel acupuncture channels and, therefore, incapable of achieving true treatment performance.

In view of the said shortcomings, the applicant of the invention herein conceived of a thoughtful and original idea based on many years of design experience and extensive investigation that, following repeated sample testing and numerous refinements, culminated in the introduction of the invention herein.

SUMMARY OF THE INVENTION

The objective of the invention herein is to provide an electro-stimulation feet acupuncture channel physiotherapy shoe, the overall design of which includes an accompanying physical treatment appliance, the supplied current enabling the physiotherapy shoe to become positively and negatively conductive that not only results in the generation of low and medium frequency electric waves having therapeutic effectiveness at the reflex areas along the soles of the feet, but also stimulates deep tissue layer muscle and connective acupuncture channels to thereby reach muscles as well as blood vessels to achieve physical treatment and health care efficacy.

DETAILED DESCRIPTION OF THE INVENTION

The brief description of the drawings are accompanied below by the detailed description of the most preferred embodiment of the present invention.

Figure 1:
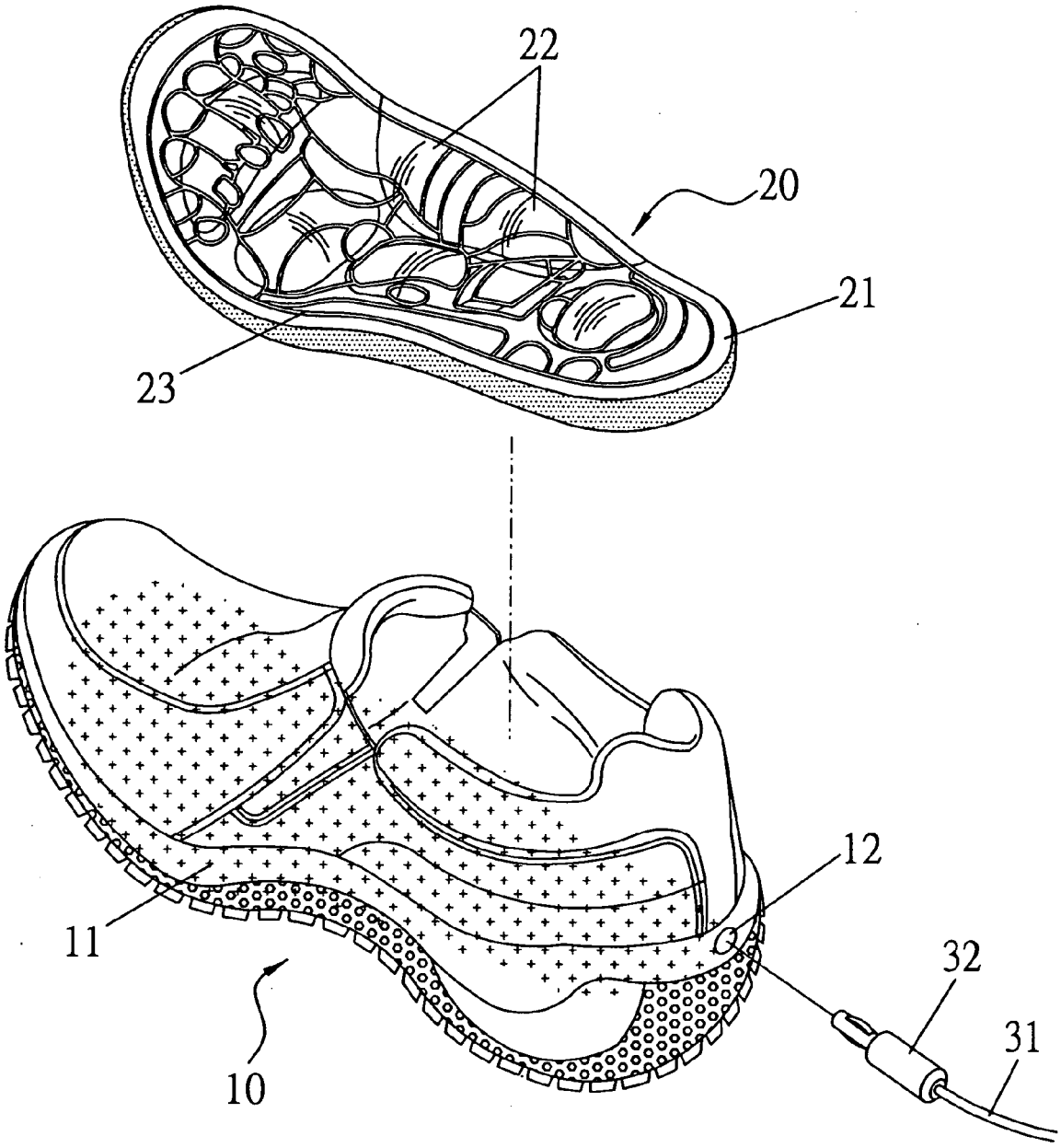
FIG. 1 is an exploded drawing of the invention herein.

Referring to FIG. 1, the said physiotherapy shoe is comprised of a shoe body 10 and a sole 20, with the said sole 20 directly fitted into the shoe body 10; conductive metal wires 11 are directly embedded along the worn interior spatial extent of the shoe body 10, a small hole 12 is formed in the shoe body 10 rear surface, a surrounding edge 21 is disposed along the periphery of the sole 20 to ensure the integrity of instep, and three-dimensional acupressure point protrusions 22 and massage protrusions 22 with built-in wire wound coils 23 that provide for electrical conductance are reliefed along the instep.

Figure 2:
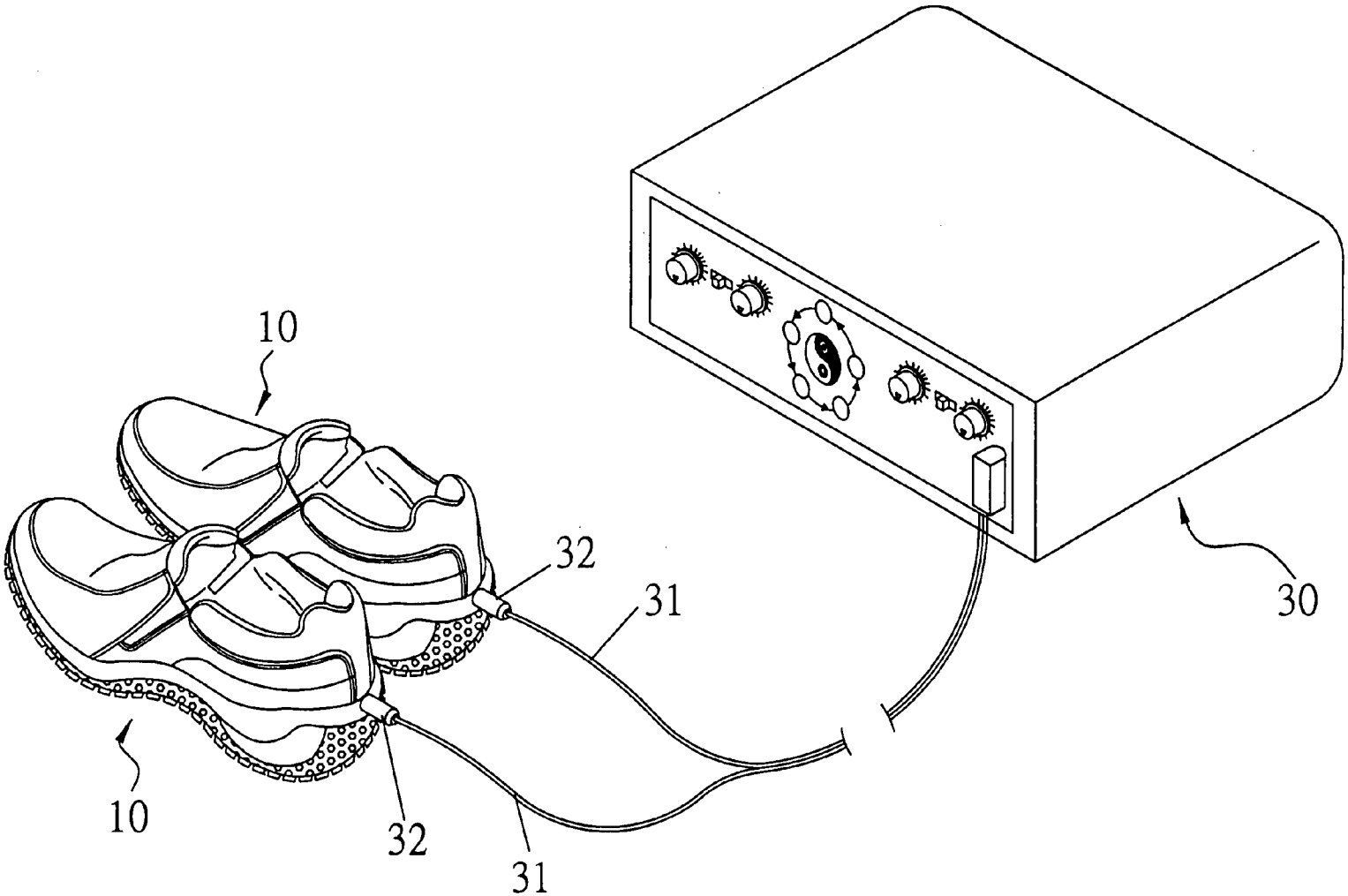
FIG. 2 is an isometric drawing of an embodiment of the invention herein.
Figure 3:
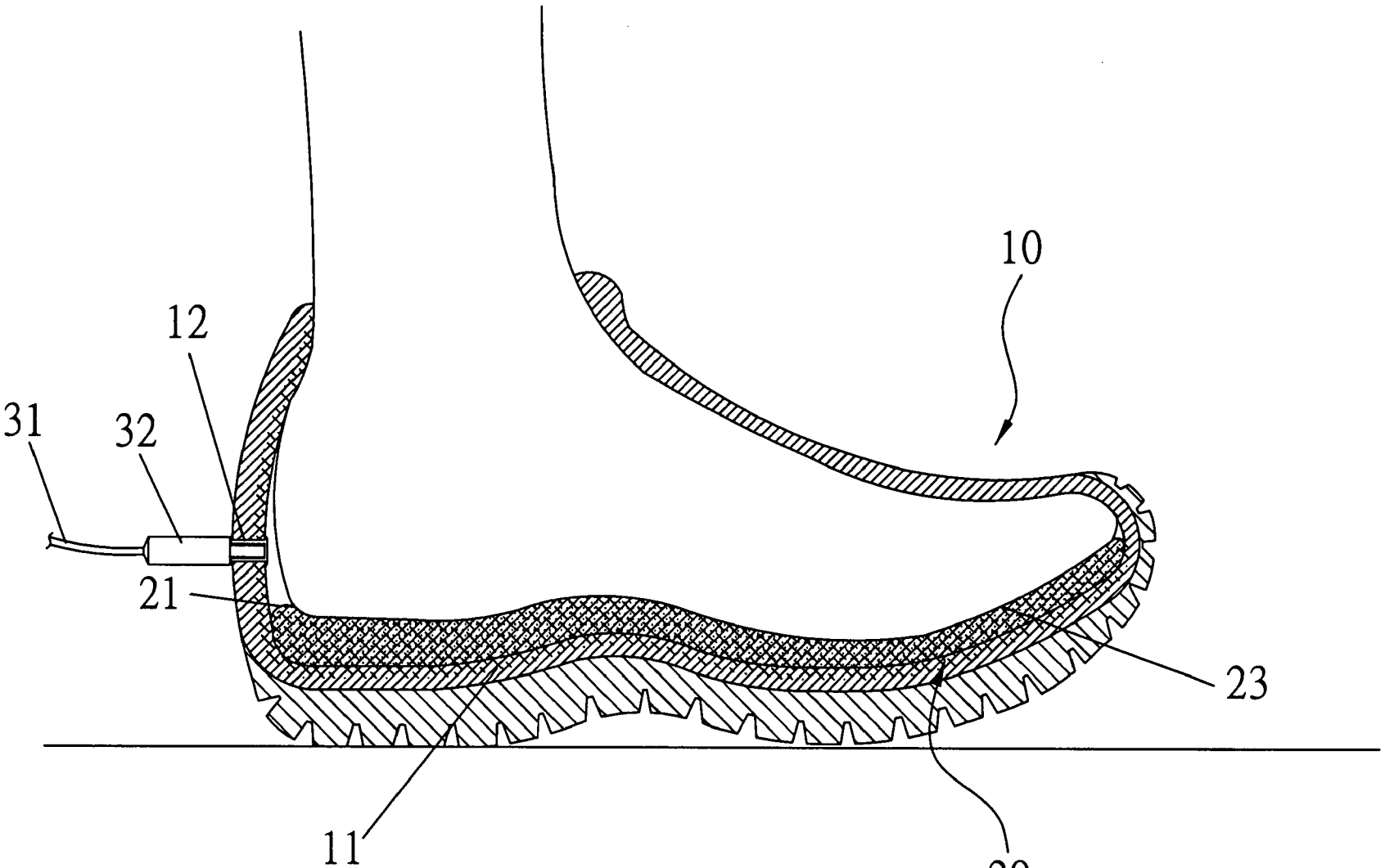
FIG. 3 is a cross-sectional drawing of the embodiment of the invention herein that illustrates utilization.

Referring to FIG. 2 and FIG. 3, when utilizing the physiotherapy shoe, it is accompanied by a physical treatment appliance 30, the physical treatment appliance 30 has a variable electric wave frequency toggle switch and a double cord 31 with two jacks 32 extending from one side of the appliance; each jack 32 is respectively plugged into the small holes 12 at rear extent of a pair of shoe bodies 20, following which the physical treatment appliance 30 electric wave is set and the feet of the user is slipped in the shoe bodies 10 such that the underside of the feet completely contact the sole 20 massage protrusions 22; the physical treatment appliance 30 is then switched on, electricity supplied to the metal wires 11 of the two shoe bodies 10 and the sole 20 wire wound coils 23 become positively and negatively conductive such that low and medium frequency electric waves electro-therapeutically stimulate acupuncture points along the soles of the feet, the electric waves not only stimulating the reflex areas of the soles with therapeutic efficacy but also achieving the stimulation of the deeper layer muscle and connecting acupuncture channels of the body which are utilized to strengthen physical immunity as well as to restore and increase natural body healing capability for physical treatment and health care applications.

In summation of the foregoing section, since the invention herein is already of an advanced innovative structure that possesses improved original content, while also capable of achieving industrial utility and progressiveness, and thus meets patent law regulations, the present invention is lawfully submitted for patent application to the patent bureau for review and the granting of the commensurate patent rights.

However, the said description only elaborates the most preferred embodiments of the invention herein and shall not be construed as limitation of the scope of the present invention; all modification and embellishments based on the patent application claims of invention herein shall remain proprietary to and protected under the claims of present invention.

The invention claimed is:

1. An electro-stimulation feet acupuncture channel physiotherapy shoe, said physiotherapy shoe comprising a shoe body and an insole; said insole being directly fitted into said shoe body and an electrical receptacle being formed in said shoe body, further comprising:

conductive metal wires directly embedded along an interior extent of the shoe body and electrically connected to said electrical receptacle, a surrounding edge disposed along the periphery of the insole, and three-dimensional acupressure point protrusions and massage protrusions with built-in wire wound coils inlaid along an instep of said insole;

wherein applying an alternating source of electricity to said conductive metal wires enables the physiotherapy shoe to conduct electricity alternately in positive and negative polarities, generating electric waves at reflex areas along a sole of a wearer's foot.

2. The electro-stimulation feet acupuncture channel physiotherapy shoe according to claim 1, wherein said alternating source of electricity is a physical treatment appliance provided with a double cord with two jacks that are respectively plugged into said electrical receptacle at a rear extent of each one of a pair of said shoe bodies, thereby enabling each physiotherapy shoe to conduct electricity alternately in positive and negative polarities for the generation of electric waves.

3. The electro-stimulation feet acupuncture channel physiotherapy shoe according to claim 1, wherein said alternating source of electricity selectively generates at least two different frequencies.

* * * * *